US009982420B1

(12) United States Patent
Romaine

(10) Patent No.: US 9,982,420 B1
(45) Date of Patent: May 29, 2018

(54) SHOWER RINSE SYSTEM AND METHOD

(71) Applicant: Dell Romaine, Hopkinsville, KY (US)

(72) Inventor: Dell Romaine, Hopkinsville, KY (US)

( * ) Notice: Subject to any disclaimer, the term of this patent is extended or adjusted under 35 U.S.C. 154(b) by 54 days.

(21) Appl. No.: 15/241,277

(22) Filed: Aug. 19, 2016

Related U.S. Application Data

(60) Provisional application No. 62/208,291, filed on Aug. 21, 2015.

(51) Int. Cl.

| | |
|---|---|
| ***A62C 5/02*** | (2006.01) |
| ***E03C 1/02*** | (2006.01) |
| ***B05B 12/02*** | (2006.01) |
| ***B05B 12/08*** | (2006.01) |
| ***E03C 1/05*** | (2006.01) |
| ***E03C 1/046*** | (2006.01) |
| ***B05B 7/24*** | (2006.01) |
| ***B05B 9/01*** | (2006.01) |
| ***B05B 7/12*** | (2006.01) |

(52) U.S. Cl.
CPC ..... *E03C 1/025* (2013.01); *B05B 7/12* (2013.01); *B05B 7/2443* (2013.01); *B05B 7/2472* (2013.01); *B05B 9/01* (2013.01); *B05B 12/02* (2013.01); *B05B 12/085* (2013.01); *E03C 1/046* (2013.01); *E03C 1/055* (2013.01)

(58) Field of Classification Search
CPC ..... E03C 1/025; E03C 1/046; E03C 1/055; B05B 12/02; B05B 12/085; B05B 7/2472; B05B 7/2443; B05B 15/061; B05B 7/12; B05B 9/01
USPC ..... 239/10, 69, 70, 71, 73, 282, 303–305, 239/310, 318, 407, 413, 525, 530; 4/596, 4/597, 615, 903
See application file for complete search history.

(56) References Cited

U.S. PATENT DOCUMENTS

| | | | | |
|---|---|---|---|---|
| 4,563,780 | A * | 1/1986 | Pollack | E03B 7/04 4/597 |
| 5,428,850 | A * | 7/1995 | Hiraishi | E03C 1/05 4/615 |
| 8,281,428 | B1 * | 10/2012 | Shrewsbury | A47K 3/282 4/604 |
| 2014/0027533 | A1 * | 1/2014 | Stiemsma | E03C 1/046 239/318 |

* cited by examiner

*Primary Examiner* — Steven J Ganey
(74) *Attorney, Agent, or Firm* — Gary K. Price

(57) ABSTRACT

A controlled shower rinse system installed in a shower stall that mixes a selected medicated substance, like a medicated shampoo for example, with the water that flows from the conventional shower head of a facility's shower system. The rinse system including a programmable dispenser for regulating the introduction of the medicated substance to the shower system, a mixer, and a sensor that supplies an electrical control signal to the dispenser for causing operation thereof to effectively blend water from the shower system's supply line with the medicated product and directing the blended water through the shower system's shower head.

20 Claims, 2 Drawing Sheets

SHOWER RINSE SYSTEM AND METHOD

CROSS REFERENCES TO RELATED APPLICATIONS

U.S. Provisional Application for Patent No. 62/208,291, filed Aug. 21, 2015, with title "Shower Rinse System and Method" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

This invention relates to a shower rinse system and method for using same for use in prisons and like facilities, and more particularly, a shower rinse system installed in shower stalls that provides a controlled process to mix a selected product, like a medicated shampoo or other chemical for example, with the water that flows from the conventional shower head of a shower device.

2. Brief Description of Prior Art

Many penal institutions, such as prisons, jails and the like require in-coming inmates for example, to shower when the inmate is initially incarcerated. It is further common for the institution to require the inmate to apply certain cleansing and/or medicated products during the shower process. While soap or the like is conventionally available for cleansing, stronger materials such as medicated shampoo or other chemicals are often required during the shower in order to effectively cleanse and remove any parasites and their eggs that may infest the skin or hair. It is obviously preferred for each inmate to achieve such a cleansing prior to that inmate joining the institution's population.

Officers working in the penal institution will often supply a selected amount of any such medicated product to the inmate just prior to the inmate entering the shower. The inmate is then instructed to manually apply the product during the shower. Obviously if the inmate applies the product improperly or intentionally avoids applying the product the risk exists that the inmate remains infested, and may therefore infest other inmates. As a result, the officer is required to monitor the inmate during the shower process in order to verify that the inmate applied the medicated product properly. Such monitoring is time consuming for the officer and a misuse of the institution's employee resources. Further, human mistake and oversight by the officer is possible resulting in the inmate remaining infested and therefore infesting the prison population.

As will be seen from the subsequent description, the preferred embodiments of the present invention overcome these and other shortcomings of prior art.

SUMMARY OF THE INVENTION

This present invention is a shower rinse system for use in prisons and like facilities, and more particularly, a shower rinse system installed with shower stalls that provides a controlled process to mix a selected product, like a medicated shampoo or other chemical for example, with the water that flows from the conventional shower head of a shower device.

DESCRIPTION OF THE PREFERRED EMBODIMENT

Figure 1:
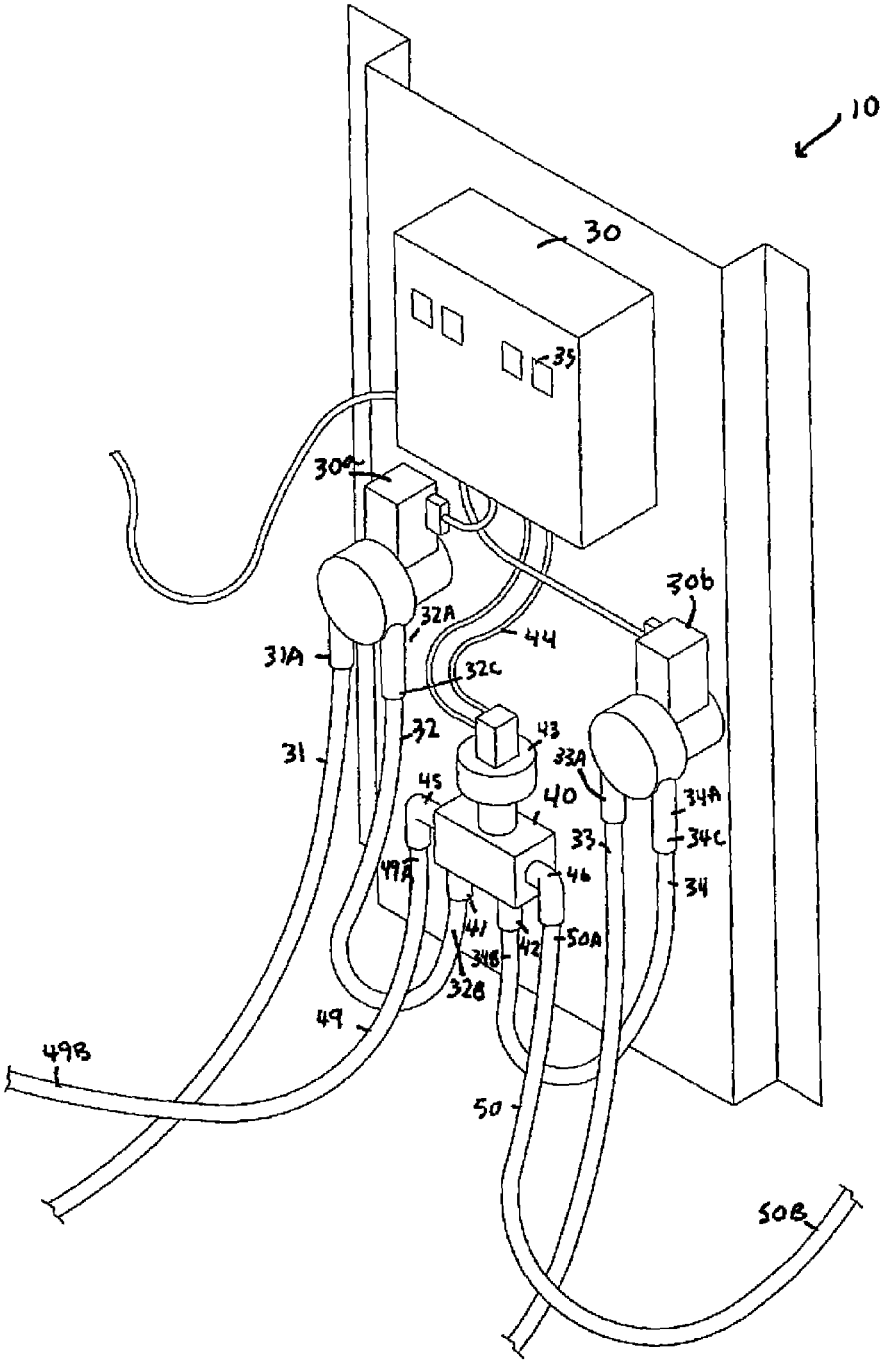
FIG. 1 is a front perspective view of a preferred embodiment of the present invention, a shower rinse system.
Figure 2:
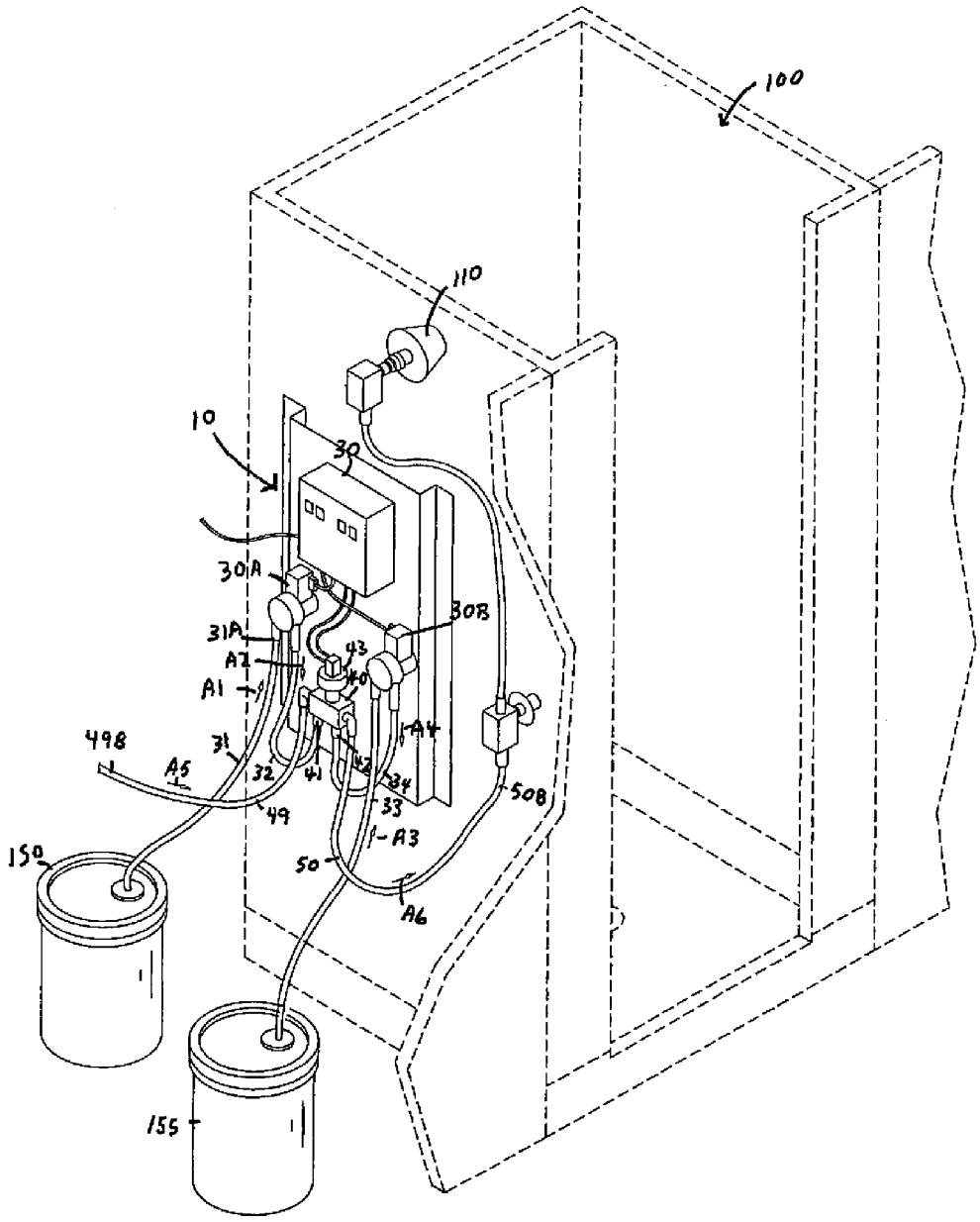
FIG. 2 is a side perspective view of the system of FIG. 1 connected with a shower stall.

FIG. 1 illustrates a preferred embodiment of a shower rinse system 10 made in accordance with the present invention. The present invention may be used in prisons and like facilities, and generally, is installed in communication with the facility's water supply (not shown) and shower stall 100 and provides a controlled process to mix a selected product, like a medicated shampoo or other chemical for example, with the water that flows from a conventional water supply line through a shower head of a shower device.

The shower rinse system 10 generally including a programmable dispenser 30, and a mixer 40 in communication with the facility's water supply and conventional shower stall 100.

As known, the shower stall 100 generally has the water supply line directed to a shower arm that is connected to the shower head 110 that projects outwardly through the wall of the shower stall. In the present invention, as will be described, the mixer 40 is in fluid communication with the shower stall's water supply line. The shower stall 100 is conventional in design.

During use, water is directed from the water supply line to the mixer 40, and then to the shower arm. The water is then disbursed from the shower head 110. While water is flowing through the mixer 40 as will be discussed, the chemical product is selectively introduced to the mixer 40 and then to the shower arm and disbursed from the shower head. The flowing water effectively blends with the introduced chemical product within the mixer 40 and is disbursed from the shower head 110.

The dispenser 30 includes a first supply pump 30A and a second supply pump 30B. The first supply pump 30A having a first flow tube 31 that has one end connected to a first chemical product supply source 150 and an opposite end 31A of the first flow tube 31 appropriately connected to the first pump 30A. As illustrated, liquid chemical products are directed from the supply source to the first pump 30A in the direction of arrow A1.

The first pump 30A further includes a second flow line 32 having a first end 32A connected to the first pump 30A and a second end 32B connected to a first outlet port 41 of the mixer 40. As illustrated, fluid transfers from the first pump 30A to the first outlet port 41 in the direction of arrow A2. The first outlet port 41 is therefore in fluid communication with the first pump 30A and can receive chemical product.

The second supply pump 30B includes a first flow tube 33 having one end connected to a second chemical product supply source 155 and an opposite end 33A of the first flow tube 33 appropriately connected to the second pump 30B. As illustrated, liquid chemical products are directed from the supply source to the second pump 30B in the direction of arrow A3. The second pump 30B further includes a second flow line 34 having a first end 34A connected to the second pump 30B and a second end 34B connected to a second outlet port 42 of the mixer 40. As illustrated, fluid transfers from the second pump 30B to the second outlet port 42 in the direction of arrow A4. The second outlet port 42 is therefore in fluid communication with the second pump 30B and can receive chemical product.

The mixer 40 further includes a first port 45 and a second port 46.

A flow tube 49 has a first end 49A connected to the first port 45 and a second, opposite end 49B in fluid communication with the water supply line. Outlet tube 50 has a first end 50A connected to the second port 46 and a second, opposite end 50B in fluid communication with the water supply line. Appropriate plumbing interconnects the multiple flow tubes with the inlet and outlet ports as described above.

A pressure switch 43 is in electrical communication 44 with the programmable dispenser 30. The pressure switch 43 for sensing fluid pressure in the facility's water line directed to the shower stall.

In an exemplary embodiment of the present invention, the dispenser 30 can receive a pressure signal from the pressure sensor 43 and activate the system, as will be further discussed, when the pressure sensor exceeds a selected threshold or setpoint. The dispenser 30 can be powered by a voltage source (not shown), while the pressure sensor 43 can be powered by a voltage regulator (not shown) that is connected to the same voltage source.

The pressure switch 43 may be adjustable but preferably the switch is set to respond when fluid pressure in the water line is 40 psi or higher. In particular, when the switch 43 detects its setpoint, the switch 43 will activate the dispenser 30 for application.

The pressure sensor 43 can be configured with a typical sensor structure with multiple resistors that can be pressure sensitive and their resistances can vary according to the pressure applied. One of skill in the art will understand that the pressure sensor 43 can include other forms that convert physical pressure to an electrical signal.

In one embodiment, water flow from the facility's water supply line is directed to first port 45 of the mixer 40 through tube 49 (in the direction of arrow A5) and then passes through mixer 40 and returns to the water supply line through second port 46, tube 50 (in the direction of arrow A6). As the water flows through mixer 40, the pressure switch 43 will sense the fluid pressure.

The dispenser 30 includes a timer 35 that can be adjusted. In the preferred embodiment, once the dispenser 30 is activated, and after a selected period of time, fifteen seconds following activation for example, the first pump 30A is programmed to send a predetermined volume of first chemical product to the mixer 40 through first inlet port 41 as described, that is mixed with water from the supply line passing through the mixer 40, and then directed to the shower stall through port 46 and tube 50 as described.

And, after a selected period of time, fifteen seconds following transfer of the first chemical product from the first pump 30A for example, the second pump 30B is programmed to send a predetermined volume of the second product to the second outlet port 42 as described that is mixed with water passing through the mixer 40, and then directed to the shower stall through port 46 and tube 50 as described. Once the second product has been transferred, the system will deactivate.

In application, an inmate enters the shower stall 100 and turns on the water for taking a shower. Once the pressure switch 43 detects its setpoint, 40 psi for example, the pressure switch 43 activates the dispenser 30. Once activated, the dispenser will preferably delay a selected period of time, fifteen seconds for example, and after such delay, the first pump 30A releases a predetermined volume of the first chemical product as described through the mixer 40 and to the water supply line. Following the first product release, the dispenser 30 has a second delay, fifteen seconds for example. After the second delay has expired, the second pump 30B releases a predetermined volume of the second product as described to the water supply line. Once the second pump has released the second product the dispenser is closed or deactivated.

As those skilled in the art will appreciate, the dispenser 30 is operated in response to a control signal. The dispenser 30 is normally closed, so that failure of the described controlled process will prevent constant chemical products from issuing to the water supply line. In this way, control of the dispenser 30 is not available or accessible to the inmate and, chemical products can be selectively supplied to the shower stall and therefore disbursed from the shower head.

As illustrated, tube 32 may include a back flow preventer 32C, and tube 34 may include a back flow preventer 34C.

As shown in the drawings, the dispenser 30 and mixer 40 is preferably mounted at a remote location from the shower stall.

Although the description above contains many specificities, these should not be construed as limiting the scope of the invention but as merely providing illustrations of a presently preferred embodiment of this invention. For example, in the embodiment discussed, water from the water supply line is diverted and directed to first port 45 and flow tube 49, and then released from the mixer 40 through second port 46 and outlet tube 50. In the alternative, water from the supply line may be diverted and directed to second port 46 of mixer 40 through outlet tube 50, and then released from the mixer 40 through first port 45 and flow tube 49. Further, while the dispenser 30 disclosed includes first and second supply pumps, it should be understood that the dispenser 30 may operate as disclosed with at least one (1) supply pump.

Thus the scope of the invention should be determined by the appended claims in the formal application and their legal equivalents, rather than by the examples given.

I claim:

1. A shower rinse system that blends a selected product with water and directs a blended solution through a shower head of a facility's shower device, said shower rinse system comprising:

a dispenser having at least one supply pump, wherein said at least one supply pumps configured to release a chemical product to a mixer, and wherein said mixer is in fluid communication with a facility's water supply line that is directed to the facility's shower device, a sensor in electrical communication with said dispenser, and wherein said dispenser configured to activate when said sensor detects that a physical water pressure in the facility's water supply line exceeds a selected setpoint and configured to deactivate once said at least one supply pump has released said chemical product.

2. The system of claim 1, said dispenser further including a timer that is programmed with said at least one supply pump.

3. The system of claim 1, wherein a flow tube is appropriately connected between said mixer and the facility's water supply line.

4. The system of claim 3, wherein said dispenser is powered by a voltage source.

5. The system of claim 4, wherein said sensor is powered by a voltage regulator that is connected to said voltage source.

6. The system of claim 5, wherein said sensor configured to convert said physical water pressure to an electrical signal that is sent to said dispenser.

7. The system of claim 1, wherein said setpoint is adjustable.

8. The system of claim 1, wherein said setpoint is 40 pounds per square inch.

9. A method for mixing a selected product with water that flows to a conventional shower head, said mixing method comprising the steps of:

entering a shower stall in a facility and turning on the water for taking a shower, wherein a sensor measures the facility's water pressure in a water line directed to the shower, activating a first pump to release a predetermined volume of a first chemical to a mixer when said sensor detects that the water pressure exceeds a selected setpoint, wherein said mixer is in fluid communication with said water line and a water inlet that is in fluid communication with the shower head, releasing a predetermined volume of a second chemical to the mixer after a selected delay from the first release step, deactivating the dispenser.

10. The method of claim 9, wherein said first pump releases said predetermined volume of the first chemical after a selected period of time.

11. The method of claim 9, wherein a flow tube is appropriately connected between said mixer and the facility's water supply line.

12. The method of claim 9, wherein said setpoint is 40 pounds per square inch.

13. A method for mixing a selected product with water that flows to a conventional shower head, said mixing method comprising the steps of:

entering a shower stall in a facility, turning on the water for taking a shower, measuring the facility's physical water pressure in a water line directed to the shower, sending a pressure signal from a sensor to a dispenser when the facility's water pressure exceeds a selected threshold, said dispenser having at least one pump configured to release a predetermined volume of a chemical product to a mixer, and wherein said mixer is in fluid communication with said water line and a water inlet that is in fluid communication with the shower head, deactivating the dispenser.

14. The method of claim 13, including the step of said at least one pump waiting a selected period of time before performing said release of a predetermined volume of chemical product step.

15. The method of claim 14, wherein said dispenser is configured to deactivate once said at least one pump has released said predetermined volume of the chemical product.

16. The method of claim 15, wherein a flow tube is appropriately connected between said mixer and the facility's water supply line.

17. The method of claim 16, wherein said sensor is powered by a voltage regulator that is connected to a voltage source.

18. The method of claim 17, wherein said sensor configured to convert said physical water pressure to an electrical signal that is sent to said dispenser.

19. The method of claim 13, wherein said threshold is adjustable.

20. The method of claim 13, wherein said threshold is 40 pounds per square inch.

* * * * *